US005258690A

United States Patent [19]

Leksell et al.

[11] Patent Number: 5,258,690

[45] Date of Patent: Nov. 2, 1993

[54] TFEL EDGE EMITTER MODULE WITH HERMETICALLY-SEALED AND REFRACTIVE INDEX-MATCHED SOLID COVERING OVER LIGHT-EMITTING FACE

[75] Inventors: David Leksell, Oakmont; Norman J. Phillips, Pittsburgh, both of Pa.

[73] Assignee: Westinghouse Electric Corp., Pittsburgh, Pa.

[21] Appl. No.: 704,555

[22] Filed: May 23, 1991

[51] Int. Cl.[5] ..... H05B 33/04

[52] U.S. Cl. ..... 313/512; 313/506

[58] Field of Search ..... 313/512, 506, 509

[56] References Cited

U.S. PATENT DOCUMENTS

| | | | |
|---|---|---|---|
| 3,346,758 | 10/1967 | Dell | 313/512 |
| 4,006,383 | 2/1977 | Luo et al. | 315/169 TV |
| 4,110,664 | 8/1978 | Asars et al. | 315/169 TV |
| 4,137,481 | 1/1979 | Hilsum et al. | 313/503 |
| 4,464,602 | 8/1984 | Murphy | 313/509 |
| 4,535,341 | 8/1985 | Kun et al. | 346/107 R |
| 4,734,723 | 3/1988 | Ishitobi | 346/160 |
| 4,767,679 | 8/1988 | Kawachi | 313/512 |
| 4,807,047 | 2/1989 | Sato et al. | 358/300 |
| 4,951,064 | 8/1990 | Kun et al. | 346/107 R |
| 5,003,222 | 3/1991 | Washo | 313/511 |
| 5,017,824 | 5/1991 | Phillips et al. | 313/13 |

FOREIGN PATENT DOCUMENTS

| | | |
|---|---|---|
| 0083196 | 6/1980 | Japan . |
| 63-91998 | 4/1988 | Japan . |

*Primary Examiner*—Donald J. Yusko
*Assistant Examiner*—N. D. Patel
*Attorney, Agent, or Firm*—R. P. Lenart

[57] ABSTRACT

A TFEL edge emitter assembly has a TFEL edge emitter module composed of a substrate and an EL stack supported on the substrate and having a light-emitting front edge, and a covering of solid material overlying the EL stack and attached to the substrate. The solid covering produces a hermetical seal with the substrate which substantially encompasses the EL stack and provide an optically transparent medium having a refractive index between that of the EL stack and air.

18 Claims, 4 Drawing Sheets

TFEL EDGE EMITTER MODULE WITH HERMETICALLY-SEALED AND REFRACTIVE INDEX-MATCHED SOLID COVERING OVER LIGHT-EMITTING FACE

CROSS REFERENCE TO RELATED APPLICATIONS

Reference is hereby made to the following copending U.S. applications dealing with related subject matter and assigned to the assignee of the present invention:

1. "A Thin Film Electroluminescent Edge Emitter Structure On A Silicon Substrate" by Z. K. Kun et al, assigned U.S. Ser. No. 273,296 now U.S. Pat. No. 5,004,956 and filed Nov. 18, 1988, a continuation-in-part of U.S. Ser. No. 235,143, now U.S. Pat. No. 5,043,631 filed Aug. 23, 1988.

2. "Process For Defining An Array Of Pixels In A Thin Film Electroluminescent Edge Emitter Structure" by W. Kasner et al, assigned U.S. Ser. No. 254,282 now U.S. Pat. No. 4,901,896 and filed Oct. 6, 1988.

3. "A Multiplexed Thin Film Electroluminescent Edge Emitter Structure And Electronic Drive System Therefor" by D. Leksell et al, assigned U.S. Ser. No. 343,697 now U.S. Pat. No. 4,899,184 and filed Apr. 24, 1989.

4. "A thin Film Electroluminescent Edge Emitter Assembly And Integral Packaging" by Z. K. Kun et al, assigned U.S. Ser. No. 351,495 now U.S. Pat. No. 4,951,064 and filed May 15, 1989.

5. "Thin Film Electroluminescent Edge Emitter Structure With Optical Lens And Multi-Color Light Emission Systems" by Z. K. Kun et al, assigned U.S. Ser. No. 353,316 now U.S. Pat. No. 5,043,715 and filed May 17, 1989, a continuation-in-part U.S. Ser. No. 280,909, now abandoned filed Dec. 7, 1988, which is a continuation-in-part of U.S. Ser. No. 248,868, now abandoned filed Sep. 23, 1988.

6. "Integrated TFEL Flat Panel Face And Edge Emitter Structure Producing Multiple Light Sources" by Z. K. Kun et al, assigned U.S. Ser. No. 377,690 now U.S. Pat. No. 5,101,137 and filed Jul. 10, 1989.

7. "Multi-Layer Structure And Method Of Constructing The Same For Providing TFEL Edge Emitter Modules" by D. Leksell et al, assigned U.S. Ser. No. 434,397 now U.S. Pat. No. 5,118,987 and filed Nov. 13, 1989.

8. "TFEL Edge Emitter Module And Packaging Assembly Employing Sealed Cavity Capacity Varying Mechanism" by Norman J. Phillips et al, assigned U.S. Ser. No. 07/434,392 now U.S. Pat. No. 5,017,824 and filed Nov. 13, 1989.

BACKGROUND OF THE INVENTION

1. Field of the Invention

The present invention relates generally to an electronically controlled, high resolution light source, and more particularly, to a thin film electroluminescent (TFEL) edge emitter module employing a hermetically-sealed and refractive index-matched solid covering over the light-emitting face.

2. Description of the Prior Art

Electroluminescence is a phenomena which occurs in certain materials from the passage of an electric current through the material. The electric current excites the electrons of the dopant in the light emitting material to higher energy levels. Emission of radiation thereafter occurs as the electrons emit or give up the excitation energy and fall back to lower energy levels. Such electrons can only have certain discrete energies. Therefore, the excitation energy is emitted or radiated at specific wavelengths depending on the particular material.

TFEL devices that employ the electroluminescence phenomena have been devised in the prior art. It is well known to utilize a TFEL device to provide an electronically controlled, high resolution light source. One arrangement which utilizes the TFEL device to provide the light source is a flat panel display system, such as disclosed in U.S. Pat. No. 4,110,664 to Asars et al and U.S. Pat. No. 4,006,383 to Luo et al, assigned to the assignee of the present invention. In a TFEL flat panel display system, light emissions are produced substantially normal to a face of the device and so provide the light source at the device face. Another arrangement utilizing the TFEL device to provide the light source is a line array, or edge, emitter, such as disclosed in a U.S. Pat. No. 4,535,341 to Kun et al, also assigned to the assignee of the present invention. In a TFEL edge emitter system, light emissions are produced substantially normal to an edge of the TFEL device and so provide the light source at the device edge. Edge emissions by the TFEL edge emitter system are typically 30 to 40 times brighter than the face emissions by the TFEL flat panel display system under approximately the same excitation conditions.

From the above discussion, it can be appreciated that the TFEL edge emitter system of the Kun et al patent potentially provides a high resolution light source promising orders of magnitude of improved performance over the TFEL flat panel face emitter system in terms of light emission brightness. For the TFEL edge emitter device to be able to reach its full commercial potential, it must be capable of use in applications where potentially harmful contaminants, such as moisture and airborne particulates, will be present.

One packaging assembly has been devised to provide a contaminant-free environment for the TFEL edge emitter device to permit its use in such applications. Such packaging assembly is disclosed in the fourth patent application cross-referenced above. This packaging assembly includes a sealed enclosure having an internal sealed cavity surrounding the light emitting edge of the TFEL edge emitter device and a front translucent glass window through which can pass light energy emitted by the TFEL edge emitter device. Also, the packaging assembly includes an oil-like liquid which fills the internal sealed cavity. The liquid has an index of refraction which matches the index of refraction of either the front glass window or the electroluminescent (EL) stack of the TFEL edge emitter device.

One major problem which has been encountered with the packaging assembly of the above-described construction is that the sealed enclosure is so rigid that thermal expansion of the liquid inside the sealed cavity due to as little as a 20° C. increase in temperature can cause the enclosure to rupture and leak. One proposal to solve this problem is disclosed in the eighth patent application cross-referenced above. In this proposal, a capacity varying mechanism, such as a rigid hollow tube having a sliding piston, a flexible sealed tube containing a gas, or a flexible bladder or diaphragm mounted across a passage to the enclosure cavity, is incorporated in the sealed enclosure. The capacity varying mechanism will accommodate thermal expansion of the liquid by increasing the enclosure cavity capacity, thereby absorbing the increase in liquid volume and preventing the rupture of the sealed enclosure. The capacity varying mechanism also will contract the capacity of the cavity as the liquid cools so as to maintain the cavity liquid-holding capacity substantially equivalent to the enclosed volume of liquid.

While these embodiments of the capacity varying mechanism have been shown to function, there a need still remains to develop a more cost-effective and efficient technique for preventing enclosure rupture and protecting the edge emitter device from contamination.

SUMMARY OF THE INVENTION

The present invention relates to TFEL edge emitter assembly designed to satisfy the aforementioned needs. The TFEL edge emitter assembly of the present invention eliminates the need to have an oil-filled cavity to protect the TFEL edge emitter module from contamination by incorporating a hermetically-sealed and refractive index-matched covering of solid material over the light-emitting face of the TFEL edge emitter module.

Accordingly, the present invention is directed to a TFEL edge emitter assembly which comprises: (a) a TFEL edge emitter module including a substrate and an EL stack supported on the substrate and having a light-emitting front edge; and (b) a covering of solid material overlying the EL stack and attached to the substrate so as to produce a hermetical seal between the covering and the substrate which substantially encompasses the EL stack and provide an optically transparent medium having a refractive index between that of the EL stack and air.

The solid covering can be in any one of several embodiments. In one embodiment, the covering of solid material includes an enclosure surrounding and enclosing at least a portion of the EL stack including said light-emitting face so as to provide a hermetic seal with the EL stack, and a solid clear adhesive coating overlying and adhered upon a front edge portion of the EL stack including the light-emitting face.

In another embodiment, the solid covering includes a transparent front plate disposed forwardly of the front edge portions of the EL stack and the substrate, and a fillet of material overlying at least a portion of the EL stack including the light-emitting face and disposed between the front plate and the front edge portions of the EL stack and substrate so as to provide a hermetic seal with the EL stack and produce a refractive index between the EL stack and the front plate.

In still another embodiment, the fillet of material of the solid covering includes an outer layer of material providing a hermetic seal with the EL stack and the front plate, and an inner layer of material providing a refractive index between the EL stack and the front plate.

In yet another embodiment, the solid covering includes the outer and inner layers of fillet material with the front plate being omitted.

These and other features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DESCRIPTION OF THE PREFERRED EMBODIMENTS

In General

Figure 1:
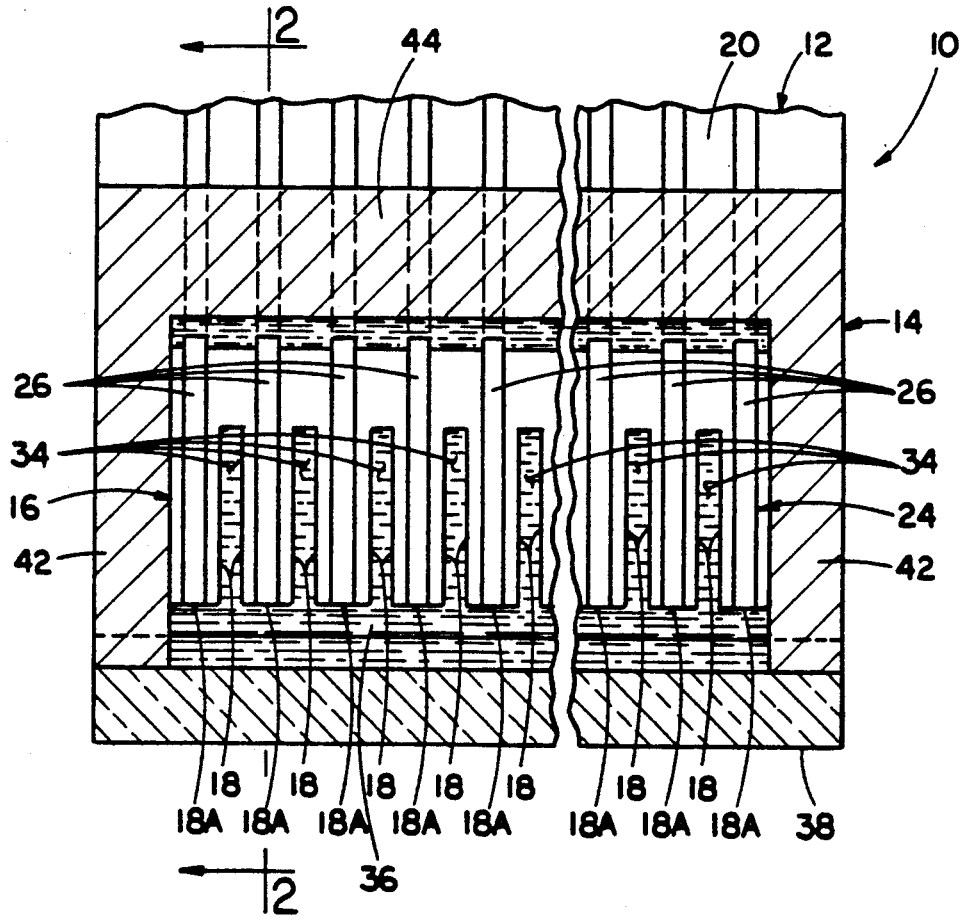
FIG. 1 (PRIOR ART)
FIG. 1 is a fragmentary longitudinal horizontal sectional view of a prior art TFEL edge emitter assembly taken along line 1—1 of FIG. 2.
Figure 2:
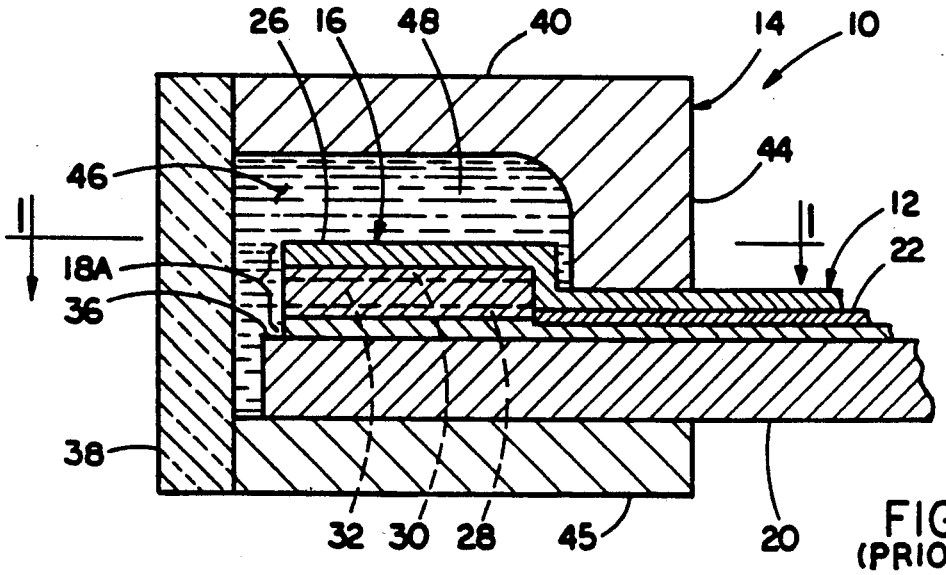
FIG. 2 (PRIOR ART)
FIG. 2 is a fragmentary longitudinal vertical sectional view of the assembly taken along line 2—2 of FIG. 1.

Referring to the drawings, and particularly to FIGS. 1 and 2, there is illustrated a TFEL edge emitter assembly, generally designated 10. The TFEL edge emitter assembly 10 is similar in construction to the one disclosed and illustrated in the fourth patent application cross-referenced above, the disclosure of which is incorporated herein by reference. The basic construction of the assembly 10 need and will only be described herein to the extent necessary to foster a complete and thorough understanding of the present invention.

The TFEL edge emitter assembly 10 basically includes a TFEL edge emitter module 12 and a sealed liquid-containing enclosure 14. The TFEL edge emitter module 12 employs an EL stack 16 having a linear array of spaced-apart pixels 18 with light-emitting front edge faces 18A. The TFEL edge emitter module 12 provides a solid state, electronically controlled, high resolution light source.

The TFEL edge emitter module 12 includes a bottom substrate layer 20, preferably fabricated of a glass material, a lower common electrode layer 22 applied over the bottom substrate layer 20, an upper electrode layer 24 composed of a plurality of upper control electrode elements 26, and the middle EL light-energy generating stack 16 disposed between the lower common electrode 22 and the upper control electrode elements 26. The middle EL stack 16 includes a lower dielectric layer 28, an upper dielectric layer 30, and a middle light-energy generating layer 32. The lower dielectric layer 28, preferably composed of silicon oxide nitride, overlies the lower common electrode layer 22 and bottom substrate layer 20. Next, the middle light-energy generating layer 32, preferably composed of a phosphor material such as zinc sulfide doped with manganese, is deposited over the lower dielectric layer 28. Then, the upper dielectric layer 30, composed of the same material as the lower dielectric layer 28, is deposited over the middle light-energy generating layer 32.

It should be understood that although the EL stack 16 is illustrated including lower and upper dielectric layers 28, 30, the lower dielectric layer 28 may be eliminated from the EL stack 16 if desired. If the lower dielectric layer 28 is not included in the EL stack 16, then it is apparent that the phosphor layer 32 will be interposed between the lower common electrode layer 24 and the upper dielectric layer 30.

The linear array of pixels 18 of the EL stack 16, which also include the lower common and upper control electrode layers 22, 24, are defined by a series of longitudinal channels 34 and a transverse street 36 defined along the front end portion of the bottom substrate layer 20 connecting the channels 34 on the forward end of the EL stack 16 and electrode layers 22, 24 down to the level of the bottom substrate layer 20. The channels 34 serve to optically isolate adjacent pixels 18 from one another to prevent optical cross-talk. The street 36 is provided as a result of the formation thereabove of the front light-emitting edges 18A of the pixels 18.

The sealed liquid-containing enclosure 14 of the assembly 10 is constructed of front, top, opposite side, rear and bottom wall portions 38, 40, 42, 44, 45. Although not required, all of the wall portions can be composed of a translucent glass. It is only required that at least the front wall portion 38 be translucent to provide a window through which light energy emitted by the front edges 18A of the pixels 18 can pass from the interior to exterior of the sealed enclosure 14. The bottom wall portion 45 is adhesively attached to the bottom side of the bottom substrate 20 of the module 12. The top, opposite side, and rear wall portions 40, 42, 44 are preferably formed from a single piece. The opposite side wall portions 42 are adhesively attached to the top side of the bottom substrate 20. The rear wall portion 44 is attached to the top side of the module 12 rearwardly of the pixels 18. The front wall portion 38 is adhesively attached to the fronts of the top, opposite side and bottom wall portions 40, 42, 45. The front, top, opposite side, rear and bottom wall portions 38, 40, 42, 44, 45 of the enclosure 14 when so sealed with one another and with the bottom and top of the TFEL edge emitter module 12 define a sealed cavity 46 which surrounds and encloses at least a portion of the EL stack 16 so as to sealably enclose the linear array of pixels 18 and front light-emitting faces 18A thereof in a contaminant-free environment.

Also, the assembly 10 includes a thermally expansive and contractive oil-type liquid 48 which substantially fills the sealed cavity 46 surrounding the portions of the EL stack 16. The liquid 48 has an index of refraction which matches the index of refraction of either the translucent enclosure front wall portion 38 or the EL stack 16.

Hermetically-Sealed And Refractive Index-Matched Covering

Turning now to FIGS. 3–7, there is illustrated several embodiments of hermetically-sealed and refractive index-matched solid coverings 50, 52, 54, 56 incorporated in respective TFEL edge emitter assembly 58, 60, 62, 64 in accordance with the present invention to avoid the problems associated with the use of the thermally-responsive oil-type liquid 48 in the prior art TFEL edge emitter assembly 10. Since many of the components of the TFEL edge emitter assemblies 58, 60, 62, 64 are substantially the same as the components described above in the prior art TFEL edge emitter assembly 10, the same reference numerals as used above will be used to identify these components in the TFEL edge emitter assemblies 58, 60, 62, 64.

Accordingly, as seen in FIGS. 3–7, the TFEL edge emitter module 12 of each assembly 58, 60, 62, 64 includes the bottom substrate layer 20, the lower common electrode layer 22 applied over the bottom substrate layer 20, the upper electrode layer 22 composed of the plurality of upper control electrode elements 26, and the middle EL light-energy generating stack 16 disposed between the lower common electrode 22 and the upper control electrode elements 26. The middle EL stack 16 includes the lower dielectric layer 28, upper dielectric layer 30, and middle light-energy generating layer 32. The lower dielectric layer 28 overlies the lower common electrode layer 22 and bottom substrate layer 20. The middle light-energy generating layer 32 is deposited over the lower dielectric layer 28. The upper dielectric layer 30 is deposited over the middle light-energy generating layer 32. The EL stack 16 includes the linear array of pixels 18 having light-emitting front faces 18A and defined by the longitudinal channels 34. The edge emitter module 12 also has the transverse street 36 defined along the front end portion of the bottom substrate layer 20 connecting the channels 34 on the forward end of the EL stack 16 and electrode layers 22, 24 down to the level of the bottom substrate layer 20.

Figure 3:
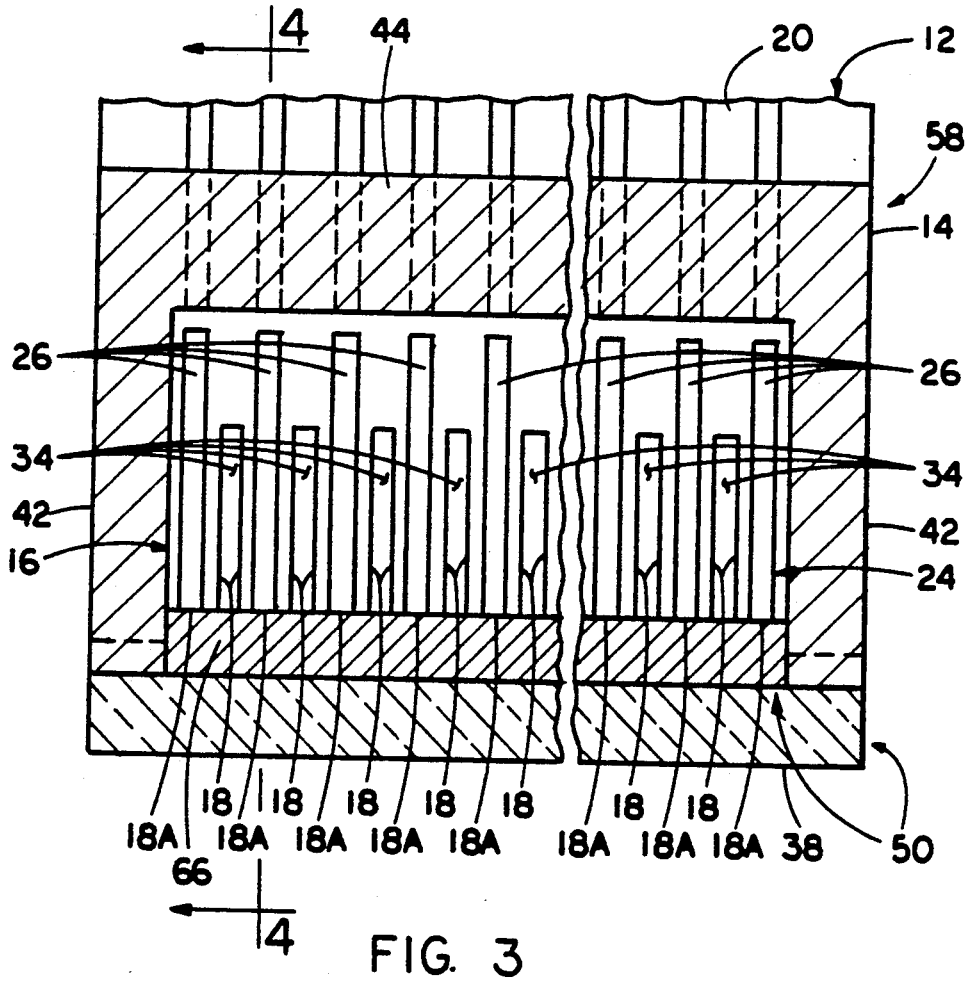
FIG. 3 is a fragmentary longitudinal horizontal sectional view of a TFEL edge emitter assembly taken along line 3—3 of FIG. 4, illustrating one embodiment of a hermetically-sealed and refractive index-matched solid covering employed in the assembly in accordance with the present invention.
Figure 4:
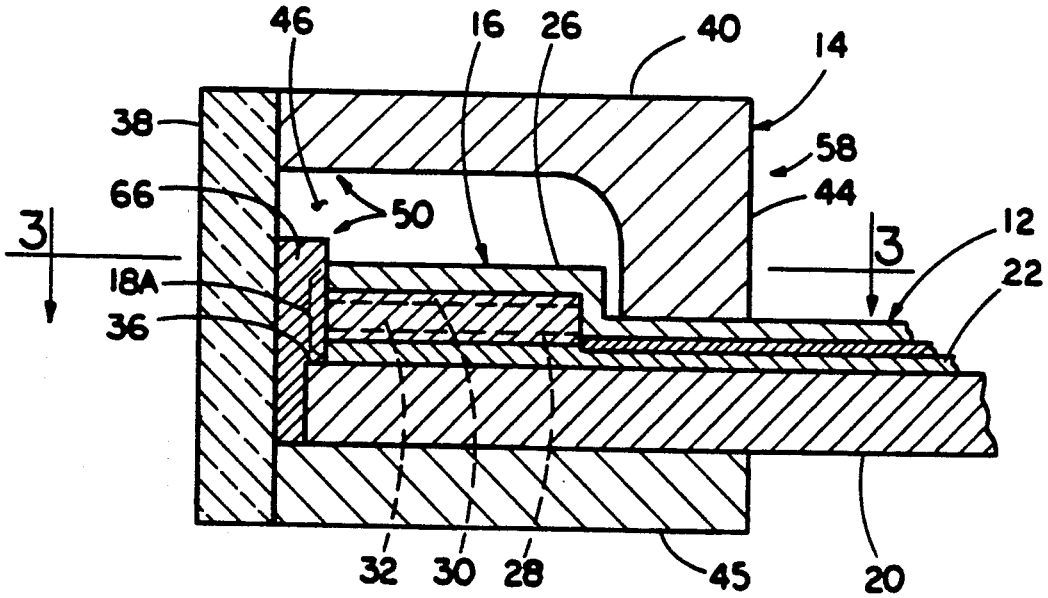
FIG. 4 is a fragmentary longitudinal vertical sectional view of the assembly and solid covering taken along line 4—4 of FIG. 3.

Referring to FIGS. 3 and 4, the TFEL edge emitter assembly 58 also includes the prior art sealed enclosure 14 constructed of the front, top, opposite side, rear and bottom wall portions 38, 40, 42, 44, 45 composed of translucent glass. The front, top, opposite side, rear and bottom wall portions 38, 40, 42, 44, 45 of the enclosure 14 are sealed with one another and with the bottom and top of the TFEL edge emitter module 12 to define the hermetically sealed cavity 46 which surrounds and encloses at least a portion of the EL stack 16 so as to sealably enclose the linear array of pixels 18 and front light-emitting faces 18A thereof in a contaminant-free environment. No liquid is contained in the sealed cavity 46; instead, the cavity 46 is purged with dry nitrogen.

The solid covering 50 is comprised of the hermetically sealed enclosure 14 and a clear epoxy coating 66 deposited over the front edge light-emitting faces 18A of the EL stack 16 so as to adhere to and encapsulate the same. The solid clear epoxy coating 66 is also disposed between the faces 18A and the front wall portion 38 of the sealed enclosure 14. Preferably, the clear epoxy coating 66 has a refractive index which matches that of the front wall portion 38. In the case of a transparent front wall portion 38 of glass material, the refractive indexes of the respective clear epoxy coating 66 and glass wall portion 38 are approximately 1.5. The refractive index of the middle light-generating layer 32 of the EL stack 16 is approximately 2.4. The epoxy coating 66 also provides rigid attachment of the front wall portion 38 to the bottom substrate 20.

Figure 5:
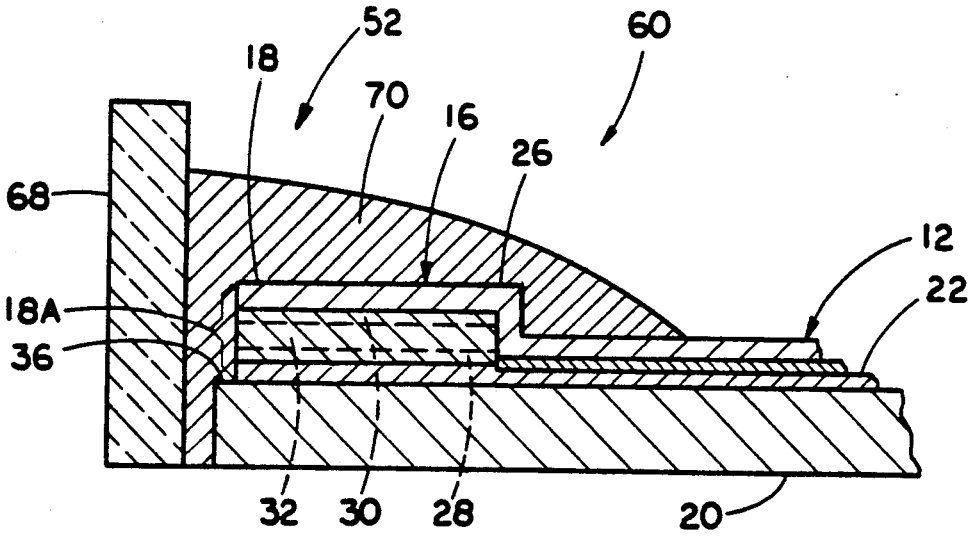
FIG. 5 is a fragmentary longitudinal vertical sectional view similar to FIG. 4 of another embodiment of the hermetically-sealed and refractive index-matched solid covering employed in the assembly in accordance with the present invention.

Referring to FIG. 5, the solid covering 52 of the TFEL edge emitter assembly 60 includes a transparent front plate 68 and a fillet of solid material 70. The transparent front plate 68 is disposed forwardly of the front edge portions of the pixels 18 of the EL stack 16 and the bottom substrate layer 20. The fillet of solid material 70 overlies the EL stack 16 and the light-emitting faces 18A of the pixels 18 thereof. The fillet of solid material 70 is also disposed between the front plate 68 and the front edge portions of the pixels 18 of the EL stack 16 and the substrate 20. The fillet of solid material 70 is a material which can provide both a hermetic seal with the pixels of the EL stack 16 and front plate 68 and produce a refractive index match with either one of the EL stack 16 or the front plate 68. Preferably, the fillet of material is a clear adhesive coating, such as Westinghouse B-565 curable conformal coating, having a refractive index which matches that of the front plate 68.

Figure 6:
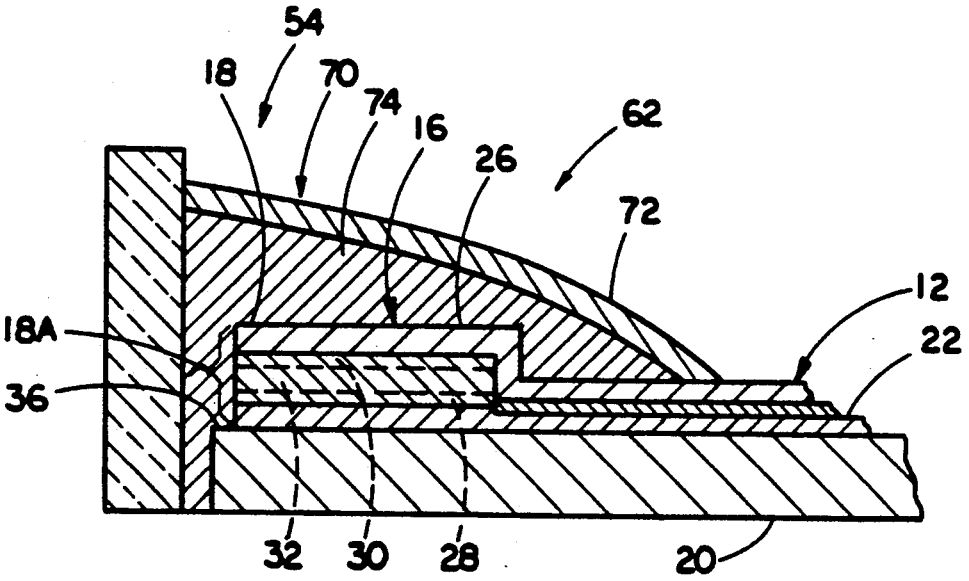
FIG. 6 is a fragmentary longitudinal vertical sectional view similar to FIG. 5 of still another embodiment of the hermetically-sealed and refractive index-matched solid covering employed in the assembly in accordance with the present invention.
Figure 7:
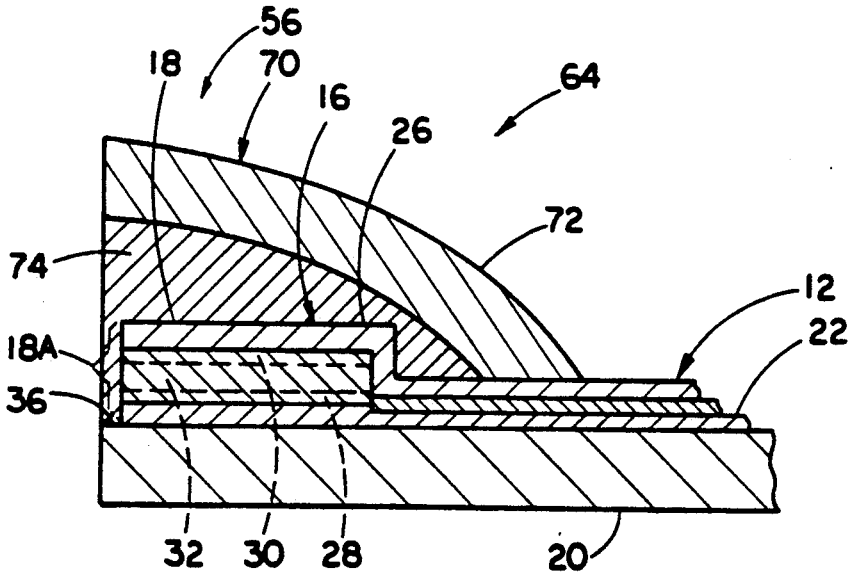
FIG. 7 is a fragmentary longitudinal vertical sectional view similar to FIG. 6 of yet another embodiment of the hermetically-sealed and refractive index-matched solid covering employed in the assembly in accordance with the present invention.
Figure 8:
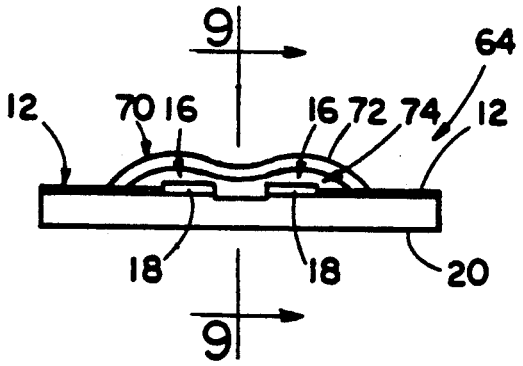
FIG. 8 is a side elevational view, on a smaller scale than that of FIG. 7, of a plurality of TFEL edge emitter modules with the solid covering of FIG. 7 applied thereon, the modules being shown before separation into individual modules.
Figure 9:
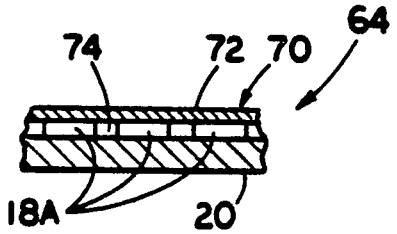
FIG. 9 is transverse vertical sectional view taken along line 9—9 of FIG. 8.

Referring to FIG. 6, the covering 54 of the TFEL edge emitter assembly 62 is the same as that in FIG. 5, except that the covering 54 is made up of two components. The first component is an outer layer of material 72, such as epo-tek #11, providing a hermetic seal with the pixels 18 of the. EL stack 16 and the front plate 68. The other component is an inner layer of material 74, such as THERMOSET UR 164, providing a refractive index between that of the EL stack 16 and the front plate 68. Referring to FIGS. 7–9, the covering 56 of the TFEL edge emitter assembly 64 is the same as that of FIG. 6, except that the front plate 68 is omitted. The outer layer of material 72 provides at least a partial hermetic seal with the pixels 18 of the EL stack, whereas the inner layer of material 74 provides a refractive index match between that of the EL stack 16 and air. FIGS. 8 and 9 illustrate the TFEL modules 12 where they share a common substrate 20 before being separated from one another between the adjacent rows of EL stacks 16.

It is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages, the forms hereinbefore described being merely preferred or exemplary embodiments thereof.

We claim:

1. A thin film electroluminescent (TFEL) edge emitter assembly, comprising:

(a) a TFEL edge emitter module including a substrate and an electroluminescent (EL) stack supported on said substrate and having a light-emitting front edge face; and (b) a covering including an adhesive coating of solid clear material deposited over said light-emitting front edge face of said EL stack and attached to said substrate so as to adhere to and encapsulate at least said light-emitting front edge face of said EL stack and produce a hermetical seal between said covering, said front edge face and said substrate which encompasses at least said light-emitting front edge face of said EL stack, said solid adhesive coating being an optically transparent medium having a refractive index between that of said EL stack and air.

2. The assembly as recited in claim 1, wherein said covering also includes:

an enclosure surrounding and enclosing at least said light-emitting front edge face of said EL stack encapsulated by said solid adhesive coating so as to provide a hermetic seal therewith.

3. The assembly as recited in claim 2, wherein:

said enclosure defines a cavity between said enclosure and said EL stack;

said assembly further comprises an inert gas filling said cavity.

4. The assembly as recited in claim 1, wherein said adhesive coating is an epoxy having a refractive index which matches that of a front wall portion of said enclosure.

5. The assembly as recited in claim 1 wherein said covering includes:

a transparent front plate disposed forwardly of said front edge face of said EL stack and said substrate;

said solid clear adhesive coating being a fillet of material overlying at least said light-emitting front edge face of said EL stack and disposed between said front plate and said front edge face of said EL stack and said substrate so as to provide said hermetic seal with said EL stack and produce said refractive index match with one of said EL stack or said front plate.

6. The assembly as recited in claim 5, wherein said fillet of material is a clear adhesive coating having a said refractive index which matches that of a front plate.

7. The assembly as recited in claim 5, wherein said fillet of material includes:

an outer layer of material providing a hermetic seal with said EL stack and said front plate; and an inner layer of material providing a refractive index match with one of said EL stack or said front plate.

8. The assembly as recited in claim 5, wherein said fillet of material is a clear adhesive coating having a refractive index which matches that said EL stack,.

9. The assembly as recited in claim 5, wherein said fillet of material includes:

an outer layer of material providing at least a partial hermetic seal with said EL stack; and an inner layer of material providing a refractive index match between that of said EL stack and air.

10. A thin film electroluminescent (TFEL) edge emitter assembly, comprising (a) a TFEL edge emitter module including a substrate and an (electroluminescent) EL stack supported on said substrate and having a linear array of spaced-apart pixels with light-emitting front edge faces; and (b) a covering including an adhesive coating of solid clear material deposited over said light-emitting front edge faces of said pixels of said EL stack and attached to said substrate so as to adhere to and encapsulate at least said light-emitting front edge faces of said pixels of said EL stack and produce a hermetical seal between said covering, said front edge faces of said EL stack pixels and said substrate which encompasses at least said front edge faces of said pixels of said EL stack, said solid adhesive coating being an optically transparent medium having a refractive index between that of said EL stack and air.

11. The assembly as recited in claim 10, wherein said covering includes:

an enclosure surrounding and enclosing at least said light-emitting front edge faces of said pixels of said EL stack encapsulated by said solid adhesive coating so as to provide a hermetic seal therewith.

12. The assembly as recited in claim 11; wherein:

said enclosure defines a cavity between said enclosure and said EL stack;

said assembly further comprises an inert gas filling said cavity.

13. The assembly as recited in claim 10, wherein said adhesive coating is an epoxy having a refractive index which matches that of a front wall portion of said enclosure.

14. The assembly as recited in claim 10 wherein said covering includes:

a transparent front plate disposed forwardly of said font edge faces of said pixels of said EL stack and said substrate;

said solid clear adhesive coating being a fillet of material overlying at least said light-emitting front edge faces of said pixels of said EL stack and disposed between said front plate and said front edge faces of said EL stack pixels and said substrate so as to provide said hermetic seal with said EL stack pixels and produce said refractive index match with one of said EL stack pixels or said front plate.

15. The assembly as recited in claim 14, wherein said fillet, of material is a clear adhesive coating having a said refractive index which matches that of a front plate.

16. The assembly as recited in claim 14, wherein said fillet of material includes:

an outer layer of material providing a hermetic seal with said EL stack pixels and said front plate; and an inner layer of material providing a refractive index match with one of said EL stack pixels or said front plate.

17. The assembly as recited in claim 14, wherein said fillet of material is a clear adhesive coating having a refractive index which matches that said EL stack pixels.

18. The assembly as recited in claim 14, wherein said fillet of material includes:

an outer layer of material providing at least a partial hermetic seal with said EL stack pixels; and an inner layer of material providing a refractive index match between that of said EL stack pixels and air.

* * * * *